US007587158B2

(12) United States Patent
Pargett et al.

(10) Patent No.: US 7,587,158 B2
(45) Date of Patent: Sep. 8, 2009

(54) SECOND TRANSFER AREA FOR AN IMAGE FORMING DEVICE AND METHODS OF USE

(75) Inventors: Stacy Marie Pargett, Richmond, KY (US); Jennifer Marie Murphy, Lexington, KY (US); Peter B. Pickett, Lexington, KY (US); Franklin Joseph Palumbo, Nicholasville, KY (US)

(73) Assignee: Lexmark International Inc., Lexington, KY (US)

( * ) Notice: Subject to any disclaimer, the term of this patent is extended or adjusted under 35 U.S.C. 154(b) by 445 days.

(21) Appl. No.: 11/536,742

(22) Filed: Sep. 29, 2006

(65) Prior Publication Data

US 2008/0080907 A1 Apr. 3, 2008

(51) Int. Cl.
*G03G 15/01* (2006.01)

(52) U.S. Cl. ..... 399/302

(58) Field of Classification Search ..... 399/302, 399/308, 303, 312, 313, 162
See application file for complete search history.

(56) References Cited

U.S. PATENT DOCUMENTS

| | | | | |
|---|---|---|---|---|
| 4,101,212 | A | 7/1978 | Sumiyoshi et al. | |
| 4,544,262 | A | 10/1985 | Kanemitsu et al. | |
| 4,839,673 | A | 6/1989 | Kegelman et al. | |
| 5,091,751 | A | 2/1992 | Inoue et al. | |
| 5,311,267 | A | 5/1994 | Bean | |
| 5,678,149 | A | 10/1997 | Takekoshi et al. | |
| 5,697,032 | A | 12/1997 | Kimura et al. | |
| 5,873,015 | A | 2/1999 | Christy | |
| 5,873,017 | A | 2/1999 | Soga et al. | |
| 6,006,062 | A | 12/1999 | Takahashi et al. | |
| 6,075,965 | A | 6/2000 | Tombs et al. | |
| 6,643,489 | B2 | 11/2003 | Omata et al. | |
| 6,697,595 | B2 | 2/2004 | Kawagoe et al. | |
| 6,829,454 | B2 | 12/2004 | Miyakawa et al. | |
| 6,834,177 | B2 | 12/2004 | Saito et al. | |
| 7,130,552 | B2 * | 10/2006 | Nishida et al. | 399/303 |
| 7,460,820 | B2 * | 12/2008 | Okabe | 399/302 |
| 2006/0051139 | A1 * | 3/2006 | Seo | 399/302 |
| 2007/0212125 | A1 * | 9/2007 | Yamaki | 399/302 |

FOREIGN PATENT DOCUMENTS

| | | | |
|---|---|---|---|
| JP | 2002341672 A | * | 11/2002 |
| JP | 2006011007 A | * | 1/2006 |

* cited by examiner

*Primary Examiner*—Susan S Lee

(57) ABSTRACT

The present application is directed to second transfer areas and methods of transfer toner images from an intermediate member to a media sheet. The second transfer area comprises a second transfer nip formed between a second transfer roller and a back-up roller. The media path moves through this nip with the toner images on the intermediate member being transferred to the media sheets. The amount of force applied by the second transfer roller affects the transferability of the toner images to the media sheet. Further, the intermediate member may contact the second transfer roller at soft nip and hard nip locations. The lengths of these nips may also affect the transferability of the toner images.

20 Claims, 4 Drawing Sheets

SECOND TRANSFER AREA FOR AN IMAGE FORMING DEVICE AND METHODS OF USE

BACKGROUND

The present application is directed to a second transfer system for transferring a toner image from an intermediate member to a media sheet and, more particularly, to aspects of the second transfer system that provide good toner transfer and higher quality images.

Image forming devices may include one or more image forming units for forming a toner image. The toner image is transferred to an intermediate member as it moves past the image forming unit. The intermediate member than moves the toner image to a second transfer area where the image is transferred to a media sheet. Good print quality results when the toner image accurately transfers to the media sheet.

A second transfer roller may be positioned at the second transfer area where the toner image is transferred to the media sheet. The intermediate member should be oriented to contact the second transfer roller and the media sheets at predetermined locations.

The image forming device should also be constructed in a manner to facilitate maintenance and repair. Many of the elements within the device may wear out or otherwise become exhausted through use requiring that they be removed and replaced. The device should be constructed such that the removal and replacement occurs in a straight-forward manner, and that print quality remains adequate. Further, the device may be constructed to be as small as possible. This sizing allows the device to be positioned in a variety of different locations within a workplace. A small overall size is often a key factor when a user is making a purchasing decision.

SUMMARY

The present application is directed to second transfer areas and methods of transferring toner images from an intermediate member to a media sheet. In one embodiment, a tension roller directs the intermediate member into a second transfer nip formed between a second transfer roller and a back-up roller. The tension roller positions the intermediate member to form a soft nip where the intermediate member contacts the second transfer roller but not the back-up roller. A hard nip may also be formed where the intermediate member contacts both the second transfer roller and the back-up roller. The pressure exerted at the second transfer nip may also result in good transfer of the toner images. In one embodiment, the combination of the length of the soft nip and the pressure at the second transfer nip results in good toner transfer.

DETAILED DESCRIPTION

The present application is directed to second transfer areas and methods of transferring toner images from an intermediate member to a media sheet. The second transfer area comprises a second transfer nip formed between a second transfer roller and a back-up roller. The media path moves through this nip with the media sheets moving along the path and receiving the toner image from the intermediate member. The amount of force applied by the second transfer roller may affect the transferability of the toner images to the media sheet. Further, the intermediate member may contact the second transfer roller at soft nip and hard nip locations. The lengths of these nips may also affect the transferability of the toner images.

The image forming device may include a laser printer (mono or color), facsimile, copier, or combination of two or more of these devices which is often referred to as an all-in-one device. The device may be sized to fit on a workspace, such as a desktop. The device may further include accessible work areas for the user to insert and remove media sheets, replace components within the device, and clear media jams from within the device.

Figure 1:
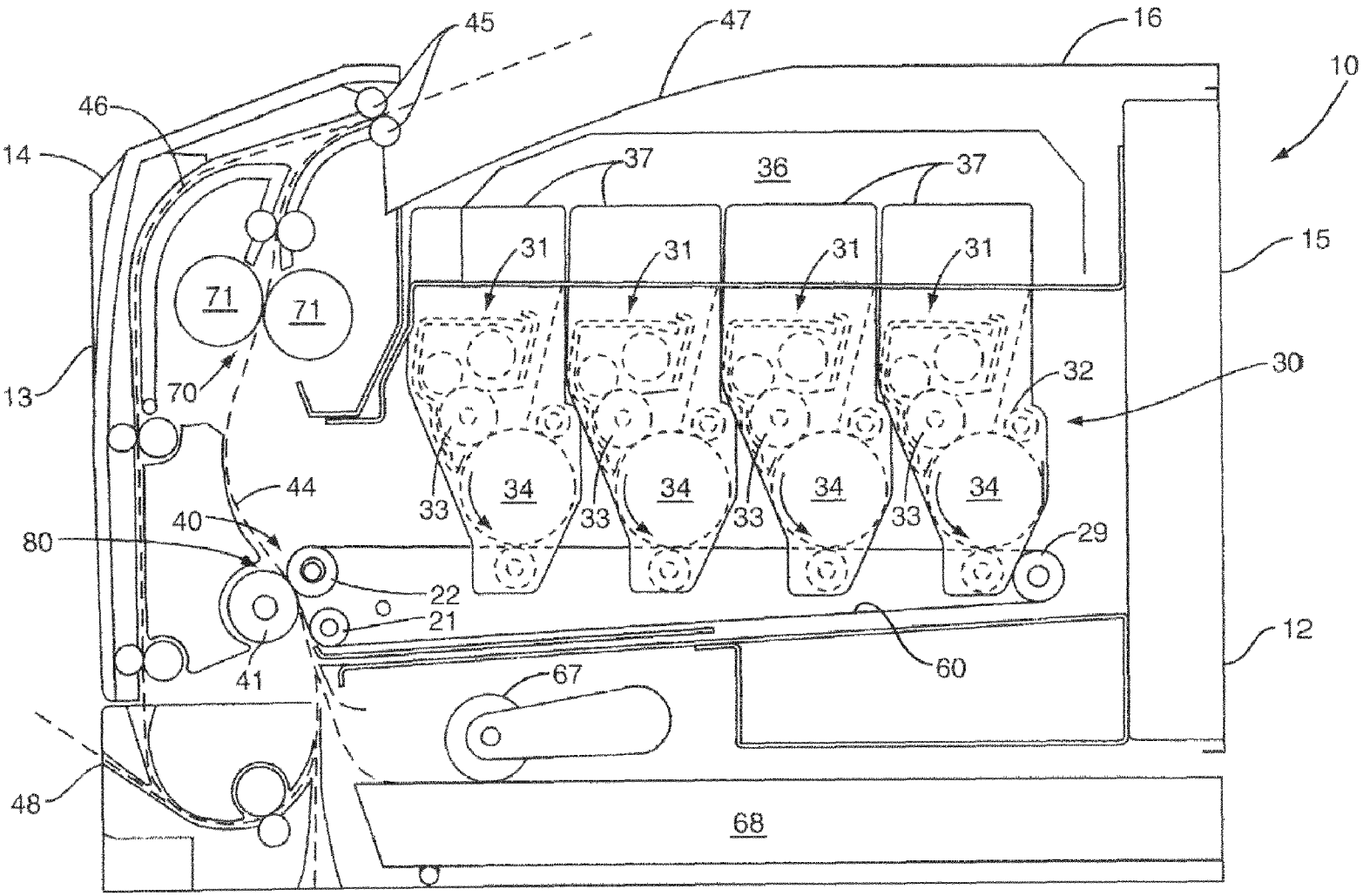
FIG. 1 is a schematic view of an image forming device according to one embodiment.

FIG. 1 illustrates one embodiment of an image forming device, generally illustrated as 10. The device 10 includes a media input tray 68 positioned in a lower section of a body 12. The tray 68 is sized to contain a stack of media sheets that will receive color and/or monochrome images. The media input tray 68 is preferably removable for refilling. Therefore, in this embodiment, a user may insert and remove the media input tray 68 from the device 10 through a front 13 of the body 12. A control panel 14 may be located on the front 13 of the body 12. Using the control panel 14, the user is able to enter commands and generally control the operation of the image-forming device 10. For example, the user may enter commands to switch modes (e.g., color mode, monochrome mode), view the number of images printed, take the device 10 on/off line to perform periodic maintenance, and the like.

A first toner transfer area 30 includes one or more imaging units 31 that are aligned horizontally extending from the front 13 to a back 15 of the body 12. Each imaging unit 31 includes a charging roll 32, a developer roll 33, and a rotating photoconductive (PC) drum 34. The charging roll 32 forms a nip with the PC drum 34, and charges the surface of the PC drum 34 to a specified voltage such as −1000 volts, for example. A laser beam from a printhead 36 contacts the surface of the PC drum 34 and discharges those areas it contacts to form a latent image. In one embodiment, areas on the PC drum 34 illuminated by the laser beam are discharged to approximately −300 volts. The developer roll 33, which also forms a nip with the PC drum 34, then transfers toner particles from a toner reservoir 37 to the PC drum 34 to form a toner image. The toner particles are attracted to the areas of the PC drum 34 surface discharged by the laser beam 35.

The toner reservoir 37 is operatively connected to each of the imaging units 31. The toner reservoirs 37 are sized to contain toner that is transferred to the imaging units 31 for image formation. The toner reservoirs 37 may be mounted and removed from the device 10 independently from the imaging units 31. In one embodiment, the toner reservoirs 37 each contain one of black, magenta, cyan, or yellow toner. Each of toner reservoirs 37 may be substantially the same, or one or more of the toner reservoirs 37 may hold different toner capacities. In one specific embodiment, the black toner reservoir has a higher capacity than the others. The toner reservoirs 37 may mount from a top 16 of the device 10, and may detach during removal with the imaging units 31 remaining within the device 10.

An intermediate transfer mechanism (ITM) 60 is disposed adjacent to each of the imaging units 31. In this embodiment, the ITM 60 is formed as an endless belt trained about support roller 29, tension roller 21 and back-up roller 22. The belt may be constructed from a variety of materials including polyimide, Ethylene TetrafluoroEthylene (ETFE), nylon, thermoplastic elastomers (TPE), polyamide-imid, and polycarbonate alloy. During image forming operations, the ITM 60 moves past the imaging units 31 in a clockwise direction as viewed in FIG. 1. One or more of the PC drums 34 apply toner images in their respective colors to the ITM 60. In one embodiment, a positive voltage field attracts the toner image from the PC drums 34 to the surface of the moving ITM 60.

The ITM 60 rotates and collects the one or more toner images from the imaging units 31 and then conveys the toner images to a media sheet at a second transfer area. The second transfer area includes a second transfer nip 40 formed between the back-up roller 22 and a second transfer roller 41.

A media path 44 extends through the device 10 for moving the media sheets through the imaging process. Media sheets are initially stored in the input tray 68 or introduced into the body 12 through a manual feed 48. The sheets in the input tray 68 are picked by a pick mechanism 67 and moved into the media path 44. In this embodiment, the pick mechanism 67 includes a roller positioned at the end of a pivoting arm. The roller rotates to move the media sheets from input tray 68 towards the second transfer area. In one embodiment, the pick mechanism 67 is positioned in proximity (i.e., less than a length of a media sheet) to the second transfer area with the pick mechanism 67 moving the media sheets directly from the input tray 68 into the second transfer nip 40. For sheets entering through the manual feed 48, one or more rollers are positioned to move the sheet into the second transfer nip 40.

The media sheet receives the toner image from the ITM 60 as it moves through the second transfer nip 40. The media sheets with toner images are then moved along the media path 44 and into a fuser area 70. Fuser area 70 includes fusing rollers or belts 71 that form a nip to adhere the toner image to the media sheet. The fused media sheets then pass through exit rollers 45 that are located downstream from the fuser area 70. Exit rollers 45 may be rotated in either forward or reverse directions. In a forward direction, the exit rollers 45 move the media sheet from the media path 44 to an output area 47. In a reverse direction, the exit rollers 45 move the media sheet into a duplex path 46 for image formation on a second side of the media sheet.

Figure 2:
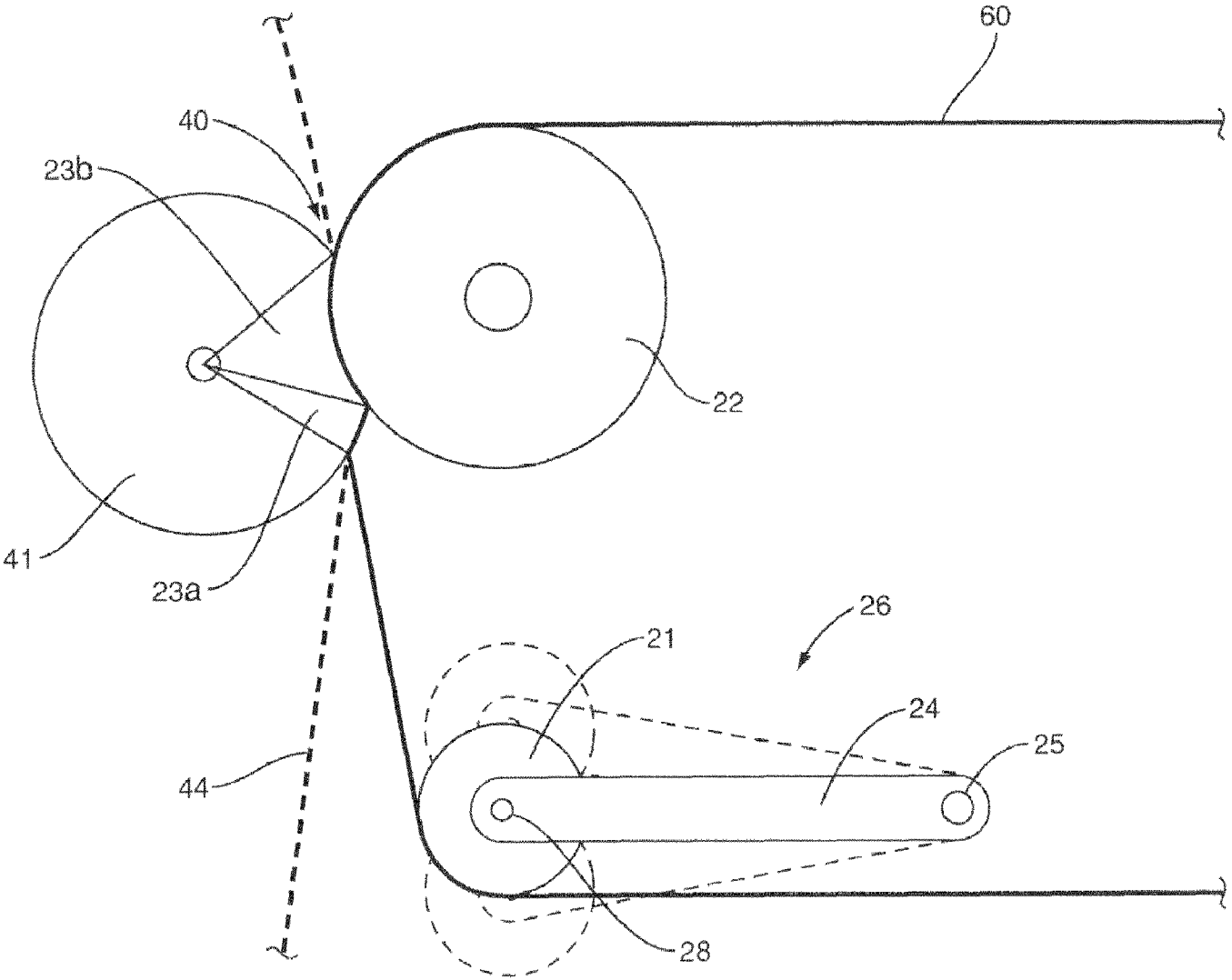
FIG. 2 is a schematic view of a section of the intermediate transfer member according to one embodiment.

FIG. 2 illustrates the ITM 60 as it moves in a clockwise direction past the tension roller 21 and through the nip 40 at the second transfer area formed between the second transfer roller 41 and the back-up roller 22. The tension roller 21 is mounted on a pivoting arm 24 and positioned to direct the ITM 60 into contact with the second transfer roller 41 prior to contacting the back-up roller 22. The tension roller 21 is positioned in close proximity to the back-up roller 22 to reduce the overall height of the device 10. In one embodiment, the center 28 of the tension roller 21 is positioned within about 30 mm of the second transfer nip 40. In another embodiment, this distance is within about 20 mm of the second transfer nip 40.

The ITM 60 first contacts the second transfer roller 41 before contacting the back-up roller 22. The first contact area, referred to as the soft nip 23*a*, is where the ITM 60 begins to wrap onto the second transfer roller 41 prior to contacting the back-up roller 22. A second contact area, referred to as the hard nip 23*b*, is where the ITM 60 is also supported by the back-up roller 22. The ITM 60 is in contact with both rollers 22, 41 in the hard nip 23*b*. As the media sheets move along the media path 44, the sheets first contact the soft nip 23*a* of the second transfer roller 41 and then proceed to the hard nip 23*b*. It has been determined that a greater soft nip 23*a* and hard nip 23*b* produce higher quality printed images.

The soft nip 23*a* may have a variety of lengths ranging from about 1.0 mm to about 4.8 mm. In one embodiment, the soft nip 23*a* has a length of about 1.7 mm. Other embodiments include a soft nip 23*a* of about 1.25 mm and about 2.6 mm. The hard nip 23*b* may also have a variety of lengths. In one embodiment, the hard nip 23*b* is about 4.0 mm.

Figure 3:
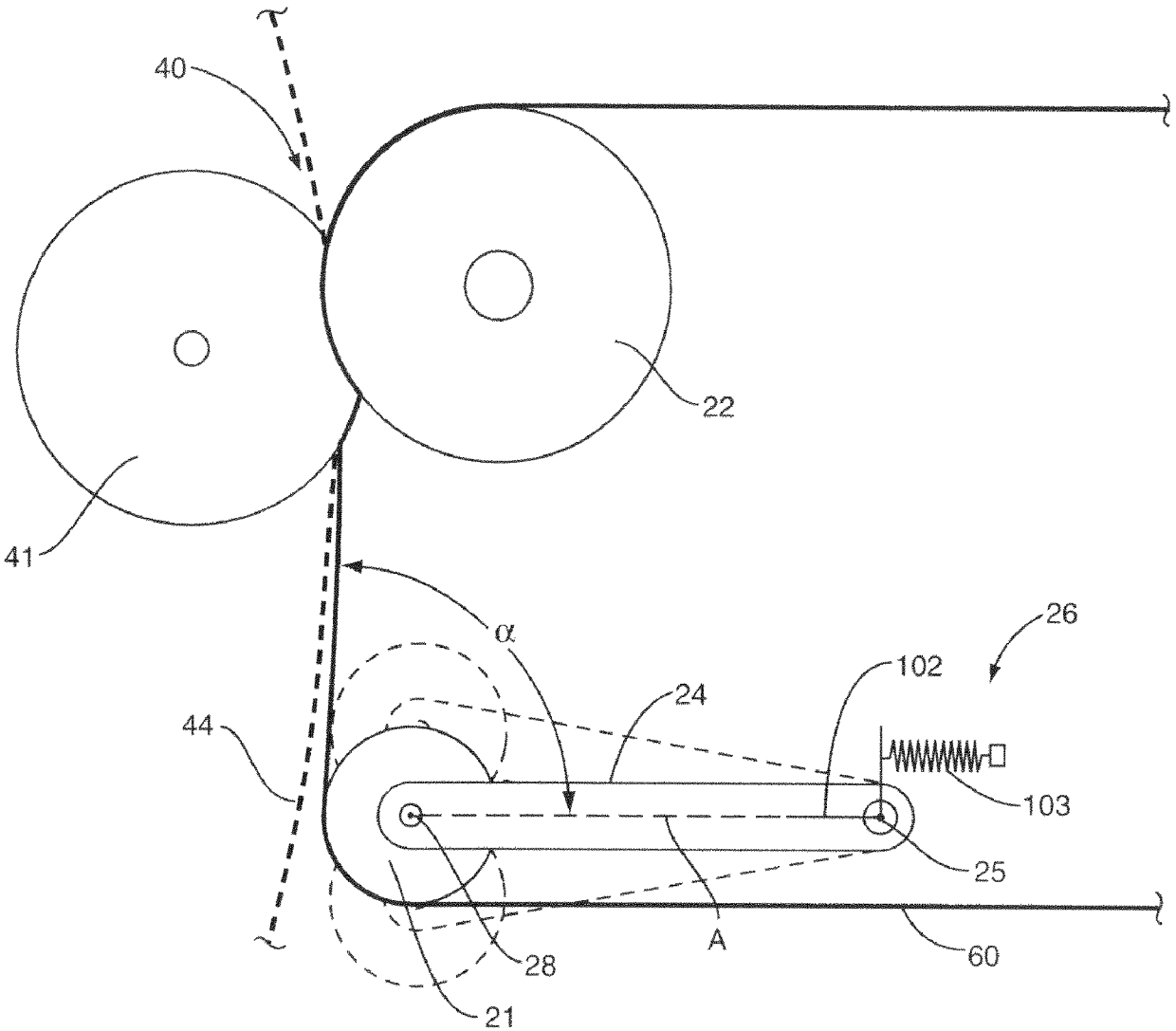
FIG. 3 is a schematic view of a tension roller and a section of the intermediate transfer member according to one embodiment.

The tension roller 21 is mounted on the end of the arm 24 and pivots about point 25. As illustrated in FIG. 3, a tensioner 26 is attached to the arm 24. Tensioner 26 positions the arm 24 and tension roller 21 to provide a predetermined amount of tension to the ITM 60. FIG. 3 illustrates one embodiment of the tensioner 26 that includes a bellcrank 102 and torsion spring 103. The tensioner 26 maintains a tension on the arm 24 to position the tension roller 21 and thus the belt 60 within a predetermined area. The arm 24 and tension roller 21 may pivot about point 25 during run-out of any or all of the rollers 21, 22, 29 that support the ITM 60. Pivoting movement causes the position of the arm 24 and tension roller 21 to move relative to the second transfer roller 41. This movement is illustrated by the solid and dashed lines indicated in FIG. 2. This motion causes the movement of the tension roller 21 to be largely in a direction tangent to the path of the ITM 60. Thus, the contact point between the ITM 60 and the second transfer roller 41 does not substantially change during movement of the arm 24.

As illustrated in FIG. 3, a line A extends through the arm 24 and the center of pivot 25 and the center 28 of the tension roller 21. In one embodiment, an angle $\alpha$ formed between line A and the path of the ITM 60 is about 90°. In other embodiments, the angle $\alpha$ formed between the line A and the ITM 60 is between about 70-110°. In still another embodiment, the angle $\alpha$ is between about 75-105°. These angles are determined when the arm 24 is at a normal, home position. The angles will change during the pivoting motion of the arm 24.

The size and positioning of the second transfer roller 41 within the main body 12 accommodates a larger roller than with previous devices. In one embodiment, the second transfer roller 41 has a diameter of about 25 mm.

Figure 4:
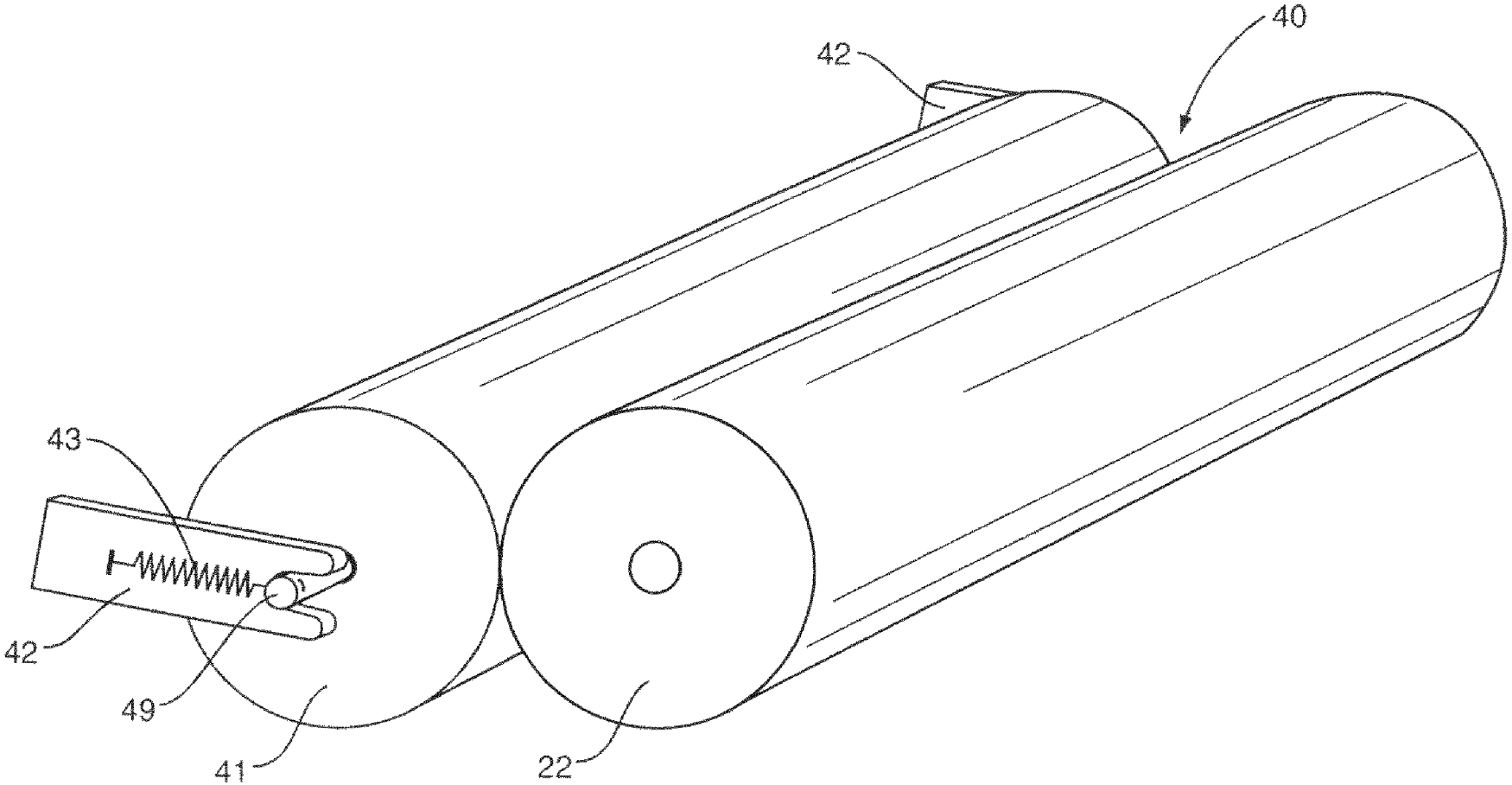
FIG. 4 is a perspective view of the second transfer area according to one embodiment.

FIG. 4 illustrates the second transfer nip 40 formed between the second transfer roller 41 and the back-up roller 22. For purposes of clarity, the ITM 60 that runs through the nip 40 is not illustrated. The second transfer roller 41 is mounted within arms 42 that extend along each axial end. A biasing mechanism 43 on each of the arms 42 attach to a shaft 49 that extends through the roller 41. The biasing mechanisms 43 force the roller 41 into the back-up roller 22. The backup roller 22 may be fixedly positioned within the body 12, or may be positioned to allow a slight amount of movement. In one embodiment, the second transfer roller 41 is softer causing it to deform when forced into contact with the back-up roller 22.

The amount of force applied by the second transfer roller 41 further affects the transfer of the toner image to the media sheet at the second transfer area 40. In one embodiment, the amount of force applied by the second transfer roller 41 is greater than about 9 g/mm. Specific embodiments include the amount of force applied by the second transfer roller 41 to be about 15 g/mm, and about 25 g/mm. In yet another embodiment, the force is about 35 g/mm. This force causes a transfer nip pressure to transfer the toner image from the ITM 60 to the media sheet. In one embodiment, the transfer nip pressure is about 0.045 $N/mm^2$.

The combination of the length of the soft nip 23*a* and the force at the second transfer nip 40 greatly affects the transfer of the toner image from the ITM 60 to the media sheet. In one embodiment, a soft nip of about 1.25 mm and a second transfer force of greater than about 15 g/mm results in good image transfer. In one embodiment, the force was about 15 g/mm. In another embodiment, the force was about 25 g/mm. In yet another embodiment, the force was about 35 g/mm.

In one embodiment, an ITM unit 80 is a replaceable component that may be removed from the body 12 and replaced with a new component. The ITM unit 80 includes the ITM 60, interior rollers 21, 22, and 29, and the second transfer roller 41. Removal and replacement of the second transfer roller 41 with the back-up roller 22 ensures that the pressure at the second transfer nip 40 is accurate upon replacement of the ITM unit.

In the embodiment described above, a force is applied to the second transfer roller 41 to form the pressure in the second transfer nip 40. In another embodiment, the force is applied through the back-up roller 22 with the second transfer roller 41 remaining relatively stationary. In another embodiment, a force is applied through both rollers to obtain the necessary nip pressure.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. In one embodiment, the back-up roller 22 is deformed due to contact with the second transfer roller 41. In another embodiment, neither of the rollers 22, 41 deform. In yet another embodiment, both rollers 22, 41 deform. The present embodiments are, therefore, to be considered in all respects as illustrative and not restrictive, and all changes coming within the meaning and equivalency range of the appended claims are intended to be embraced therein.

What is claimed is:

1. An intermediate transfer device for an image forming apparatus, the device comprising:

a belt including a first side and a second side;

a tension roller positioned in contact with the first side of the belt; and a transfer nip positioned downstream from the tension roller and formed by a back-up roller positioned in contact with the first side of the belt and a transfer roller positioned in contact with the second side of the belt;

the tension roller positioned to direct the belt to initially contact the transfer roller prior to contacting the back-up roller;

the transfer nip applying a force greater than about 9 g/mm to the back-up roller.

2. The device of claim 1, wherein the belt moves alone a belt path that extends between the tension roller and the transfer roller, the tension roller is mounted on a pivot arm that is substantially perpendicular to the belt path.

3. The device of claim 1, wherein the belt moves along a belt path that extends between the tension roller and the transfer roller, the tension roller is mounted on a pivot arm that forms an angle of between about 70° and about 110° with the belt path.

4. The device of claim 1, wherein the belt moves directly from the tension roller to the transfer roller.

5. The device of claim 1, wherein the force applied by the transfer nip is greater than about 25 g/mm.

6. The device of claim 1, wherein the force applied by the transfer nip is greater than about 35 g/mm.

7. The device of claim 1, wherein the belt contacts the transfer roller along a length of at least about 1.25 mm prior to contacting the back-up roller.

8. An intermediate transfer device for an image forming apparatus, the device comprising:

a belt including a first side and a second side;

a tension roller positioned in contact with the first side of the belt and maintain tension on the belt;

a back-up roller positioned in contact with the first side of the belt, the back-tip roller positioned downstream from the tension roller; and a transfer roller positioned in contact with the second side of the belt, the transfer roller forming a nip with the back-up roller;

wherein the tension roller is positioned to direct the belt to initially contact the transfer roller at a point upstream from the nip;

wherein the nip includes a transfer force greater than about 9 g/mm.

9. The device of claim 8, wherein the belt moves along a belt path that extends between the tension roller and the transfer roller, the tension roller is mounted, on a pivot arm that is substantially perpendicular to the belt path.

10. The device of claim 8, wherein the belt moves directly from the tension roller to the transfer roller.

11. The device of claim 8, wherein the force applied by the nip is less than about 35 g/mm.

12. The device of claim 8, wherein the belt contacts the transfer roller along a length of at least about 1.25 mm prior to contacting the back-up roller.

13. The device of claim 8, wherein the nip includes a length of about 4 mm.

14. An intermediate transfer device for an image forming apparatus, the device comprising:

a belt including a first side and a second side;

a tension roller positioned in contact with die first side of the belt;

a transfer nip positioned downstream from the tension roller and formed by a back-up roller positioned in contact with the first side of the belt and a transfer roller positioned in contact with the second side of the belt;

a soft nip including a length of at least about 1.25 mm formed between the belt and the transfer roller;

a hard nip formed between the transfer roller and the back-up roller, the hard nip positioned downstream from the soft nip;

the transfer nip applying a force greater than about 9 g/mm to the back-up roller.

15. The device of claim 14, wherein the tension roller is positioned to direct the belt directly into contact with the transfer roller.

16. The device of claim 14, wherein the belt moves along a belt path that extends between the tension roller and the transfer roller, the tension roller being pivotally positioned to move along a line substantially tangent to the belt path.

17. The device of claim 14, wherein the force applied by the transfer roller to the back-up roller is between about 9 g/mm and about 35 g/mm.

18. The device of claim 14, wherein the transfer roller is softer than the back-up roller and the transfer roller deforms within the nip.

19. The device of claim 14, wherein the belt moves through a substantially vertical section that extends between the tension roller and the back-up roller, the transfer roller contacting the belt within the substantially vertical section.

20. The device of claim 14, wherein the tension roller is positioned within about 30 mm of the soft nip.

* * * * *